United States Patent [19]

Miller

[11] 4,032,265

[45] June 28, 1977

[54] SUCTION STABILIZER FOR RECIPROCATING PUMPS AND STABILIZING METHOD

[75] Inventor: John E. Miller, Dallas, Tex.

[73] Assignee: United States Steel Corporation, Pittsburgh, Pa.

[22] Filed: July 19, 1974

[21] Appl. No.: 489,971

[52] U.S. Cl. ..... 417/540; 138/30; 137/568

[51] Int. Cl.² ..... F04B 11/00; F16L 55/04

[58] Field of Search ..... 138/30; 417/450, 542; 137/568

[56] References Cited

UNITED STATES PATENTS

| | | | |
|---|---|---|---|
| 2,094,457 | 9/1937 | Lattner | 417/540 X |
| 2,347,379 | 4/1944 | Teeter | 417/540 |
| 2,485,752 | 10/1949 | Laspe et al. | 417/540 X |
| 2,773,455 | 12/1956 | Mercier | 417/540 |
| 3,486,530 | 12/1969 | Mercier | 138/30 |
| 3,693,348 | 9/1972 | Mercier | 138/30 |

*Primary Examiner*—Carroll B. Dority, Jr.
*Assistant Examiner*—Ira S. Lazarus
*Attorney, Agent, or Firm*—Walter P. Wood

[57] ABSTRACT

A suction stabilizer for reciprocating pumps and method of stabilizing the inflow of liquid to the suction side of the pump. The stabilizer comprises a substantially cylindrical tank, a perforate-walled cage at one end of the tank, and a flexible resilient gas-filled bladder within the cage. Liquid passes through the tank as it moves from a source to the suction side of the pump. Between suction strokes the liquid compresses gas in the bladder. During suction strokes the pressure of the gas adds to the head of liquid entering the pump. The invention involves critical ratios of the tank volume to both the pump displacement and the bladder volume.

9 Claims, 6 Drawing Figures

SUCTION STABILIZER FOR RECIPROCATING PUMPS AND STABILIZING METHOD

This invention relates to an improved suction stabilizer for reciprocating pumps and to an improved method of stabilizing the inflow of liquid to the suction of a reciprocating pump.

A reciprocating pump alternately undergoes suction strokes and discharge strokes which draw liquid into its cylinders and force the liquid therefrom. Hence the pump is a variable demand mechanism, but usually it is fed from a source of liquid under a constant head. Ideally a reciprocating pump is fed from a large head located immediately adjacent its suction side, but most layouts do not provide this. Long lines or small diameter lines leading from the source to the suction side of the pump, or turns or fittings in the line, or low head or volatile liquids, for example, create poor suction conditions. One result of poor suction conditions is that the pump cylinders do not fill completely, and the pump operates less efficiently.

To improve poor suction conditions, it is known to install a stabilizer at the suction side of a reciprocating pump. For exemplary showings of suction stabilizers used heretofore, reference can be made to Day U.S. Pat. No. 2,712,831, Wilson U.S. Pat. No. 2,934,025, Cornelsen U.S. Pat. No. 3,146,724 or Zahid U.S. Pat. No. 3, 782,418. Accumulators which comprise a tank and a gas filled bladder within the tank are well known for use on the discharge side of reciprocating pumps. Reference can be made to any of several patents to E.M. Greer, for example U.S. Pat. Nos. 3,211,348, 3,494,378 or 3,593,746, for showings. Accumulators of such construction have been installed as stabilizers on the suction side, but have not proved effective.

An object of my invention is to provide an improved suction stailizer and stabilizing method which are more effective in stabilizing inflow of liquid to a reciprocating pump than stabilizers and stabilizing methods used heretofore.

A further object is to provide an improved bladder-type stabilizer and stabilizing method in which the ratio of tank volume to pump displacement per revolution is at least ten to one, and the ratio of tank volume to bladder volume is at least four to one, values which I have found to be critical for obtaining optimum stabilization of liquid flow from a source into a pump.

A further object to provide an improved stabilizer and stabilizing method which enable gas entrained in the liquid from the source to be removed before the liquid enters the pump.

Figure 1:
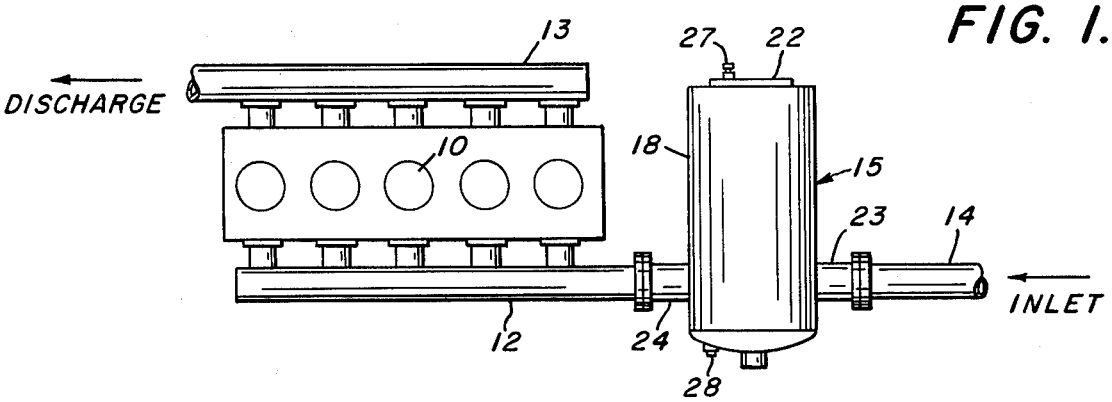
FIG. 1 is a diagrammatic end elevational view of a quintuplex reciprocating pump equipped with one form of suction stabilizer constructed in accordance with my invention.

FIG. 1 shows a conventional reciprocating pump, for example, a slurry pump, a mud pump used in well drilling, or pipe-line pump, or other type. The pump illustrated is a quintuplex which comprises a plurality of cylinders 10, a suction manifold 12 and a discharge manifold 13. The reciprocating elements of the pump are driven through a crankshaft and connecting rods or the like of any standard or desired constuction, and they draw liquid into each cylinder in turn from the suction manifold, and force the liquid from each cylinder in turn into the discharge manifold. The pump of course has the usual inlet and discharge valves which open and close between strokes. In the interest of simplicity, the drive and valves are not shown. An inlet line 14 extends from a source of liquid, and is connected to the suction manifold 12 through a suction stabilizer 15 constructed in accordance with my invention.

Figure 2:
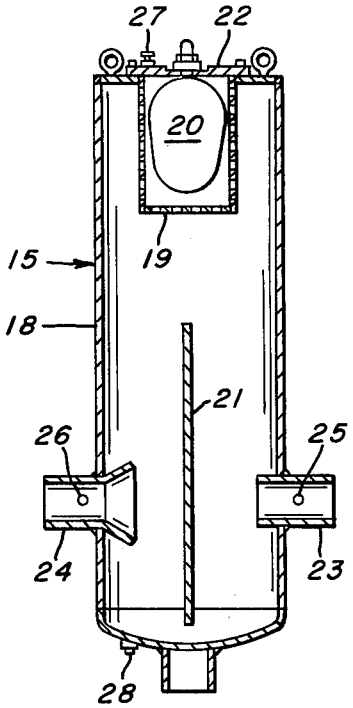
FIG. 2 is a vertical sectional view of the stabilizer shown in FIG. 1.

FIG. 2 shows a form of stabilizer 15 which I prefer for clean liquids and which includes a cylindrical tank 18, a cage 19 within the tank fixed to its upper end wall, a bladder 20 of flexible resilient material (for example rubber) within the cage, and a transverse baffle 21 within the tank spaced beneath the cage. In this form the tank is positioned with its longitudinal axis vertical. The bladder is suspended from a removable cover 22 for the cage. The cage walls are perforate to permit liquid to contact the outside of the bladder, but prevent the bladder from wobbling. The tank has an inlet 23 and a diametrically opposed outlet 24 in its side walls. Baffle 21 extends vertically diametrically of the tank from adjacent the bottom thereof to a height substantially above the inlet and outlet, whereby liquid passing through the tank passes over the top of the baffle. The inlet and outlet have pressure taps 25 and 26 respectively. The tank has a vent 27 in its top and a drain 28 in its bottom.

Figure 3:
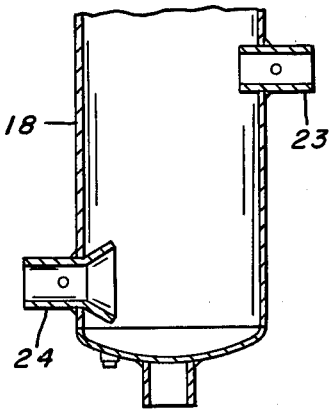
FIG. 3 is a fragmentary vertical sectional view similar to FIG. 2, but showing a modification.

FIG. 3 shows a modified form of stabilizer which I prefer for liquids containing an appreciable content of solid particles, such as muds or slurries. In this form I eliminate the baffle, since a baffle may act as a dam or it may wear rapidly on being struck by solid particles. Instead I locate the inlet 23 and outlet 24 in some relation other than in direct alignment, whereby the direction of flow of the liquid changes as the liquid passes through the tank. The effect is much the same as that obtained with a baffle, as hereinafter explained. In other respects, this stabilizer is constructed similarly to the form shown in FIG. 2; hence I do not repeat the showing or description.

Figure 4:
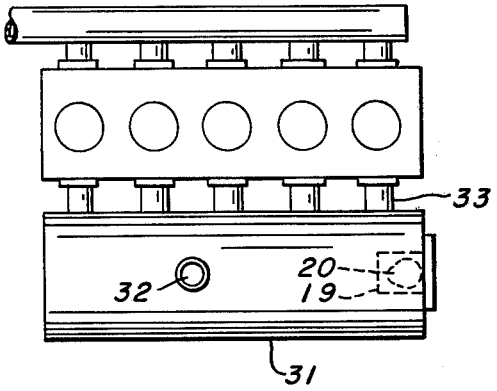
FIG. 4 is a diagrammatic view similar to FIG. 1, but showing a modified form of stabilizer.

FIG. 4 shows a modification in which the stabilizer 31 itself serves as a suction manifold. The stabilizer is positioned beneath the pump with the longitudinal axis of its tank extending horizontally. The side walls of the tank have an inlet 32 and a plurality of outlets 33 leading the respective cylinders of the pump. The outlets are out of alignment with the inlet, as in the form shown in FIG. 3. The cage and bladder are similar to those used in the form shown in FIG. 2, except that they are mounted on an end wall of the tank.

Figure 5:
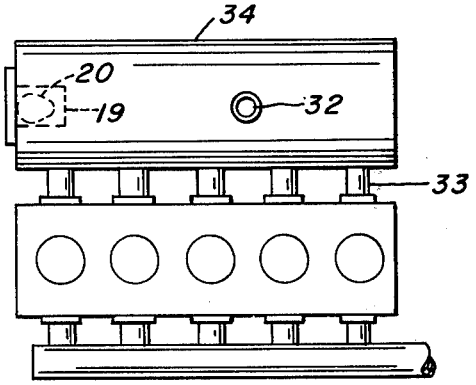
FIG. 5 is another diagrammatic view similar to FIG. 1, but showing another modified form of stabilizer.

FIG. 5 shows another modification in which the stabilizer 34 is positioned above the pump. In all other respects the form shown in FIG. 5 is similar to that shown in FIG. 4.

The present invention involves several novel and critical relations. The ratio of the tank volume to the pump displacement per revolution should be at least about 10 to 1. The pump of course has a given displacement per revolution of its drive. The ratio of the tank volume to the bladder volume should be at least about four to one when the bladder is inflated to its normal operating pressure. In referring to the "tank volume", I mean the volume of liquid which the tank may contain. In both instances there is no harm if the foregoing ratios are exceeded, but little advantage. The bladder is inflated with gas, preferably nitrogen, to an initial pressure in the range of about 40 to 60% of the suction pressure as can be determined at the pressure tap 26 (FIG. 2).

In operation, (with reference to FIGS. 1 and 2) the tank 18 fills with liquid introduced via inlet 23. As the liquid passes through the tank, its direction of flow changes as it passes over the baffle 21. The liquid passes from the tank via the outlet 24 into the suction manifold 12. Between suction strokes of the pump, liquid entering the tank compresses the gas within the bladder 20. During each suction stroke pressure of gas within the bladder adds to the head on the liquid entering the pump and assures a smooth flow of liquid into the pump, whereby each cylinder in turn fills completely. Liquid moves continuously from the source, not merely when the pump undergoes suction strokes. As the direction of flow changes, any gas entrained in the liquid tends to separate out and collect in the upper portion of the tank. When an appreciable volume of gas has accumulated, I open vent 27 to release the accumulation. The vent can be opened either manually or periodically open automatically.

In the modifications shown in FIGS. 3, 4 and 5 the change in direction of flow which the liquid undergoes between the inlet and outlet tends to separate gas entrained in the liquid, much the same as passing the liquid over a baffle.

Figure 6:
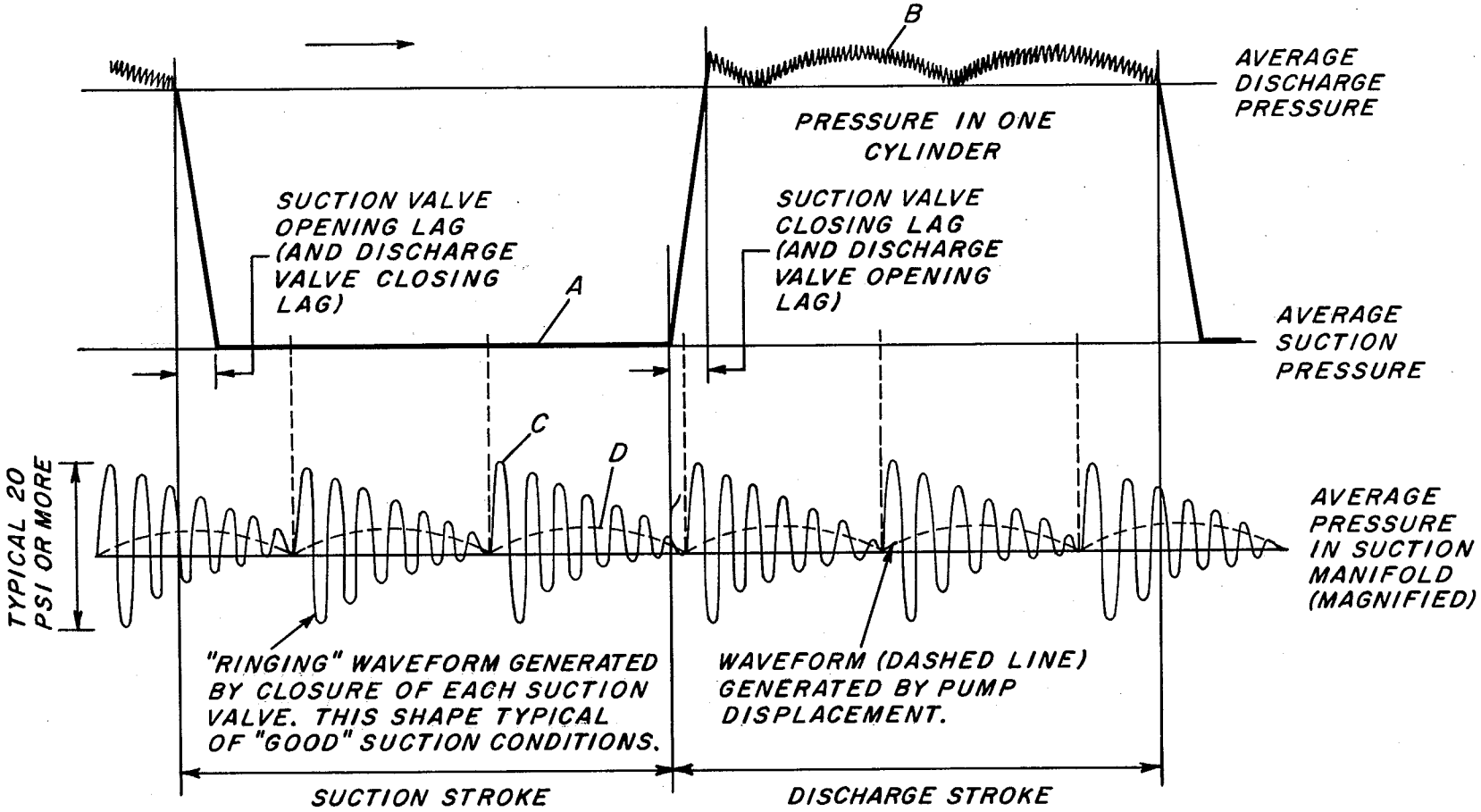
FIG. 6 is a graph which shows how cylinder pressure and suction manifold pressure in a reciprocating pump vary during a pumping cycle.

FIG. 6 shows graphically the way in which both the pressure in one cylinder and the pressure in the suction manifold varying during one cycle of one cylinder in a quintuplex pump constructed as shown in FIG. 1 operating with good suction conditions but without a stabilizer. The upper graph shows the cylinder pressure, which is atmospheric or zero gauge during the suction stroke and rises to a slightly uneven plateau during the discharge stroke, as indicated at A and B respectively. The sloping portions of the curve represent the periods during which the valves are opening and closing. The lower graph resolves the suction manifold pressure into two component curves C and D. Curve C, shown in solid lines, represents the pressure waveform generated by the closing of each suction valve. Ideally this curve is in the form of a series of smoothly diminishing sine waves, the amplitude of which reach a maximum at the instant each suction valves closes. This pressure variation results from a "ringing"effect as the valve closes. Curve D shown in dotted lines, represents the wave form generated by pump displacement. If suction conditions are poor, both curves become highly irregular.

Addition of a properly designed suction stabilizer assures that curve C takes the form illustrated in FIG. 6. The stabilizer does not improve the shape of this curve when compared with a pump which operates under good suction conditions without a stabilizer, but assures that suction conditions become good if they are not already. Addition of a properly designed suction stabilizer eliminates curve D. The pump displacement pressure becomes constant, or nearly so.

From the foregoing description, it is seen that my invention affords a simple suction stabilizer and stabilizing method which assure good suction conditions at the suction side of a reciprocating pump. The various ratios and the pressure relation listed hereinbefore are novel and critical to achieving optimum results. The arrangement of FIGS. 1, 2 and 3 offers the advantage of providing a greater head on the liquid entering the suction manifold than the arrangement of FIGS. 4 and 5.

I claim:

1. The combination, with a reciprocating pump which has suction and discharge sides and a given displacement per revolution of its drive, and a source of liquid, of a suction stabilizer comprising:

a tank having an inlet connected to said source and an outlet connected to the suction side of said pump;

a flexible resilient bladder within said tank adapted to be inflated with gas;

a cage having perforate walls within said tank adjacent an end wall thereof and confining said bladder against wobbling; and means for changing the direction of flow of liquid as the liquid passes through the tank and thus separating entrained gases from the liquid;

the ratio of the tank volume to the pump displacement per revolution being at least about ten to one;

the ratio of the tank volume to the bladder volume when inflated being at least about four to one.

2. A combination as defined in claim 1 in which said bladder is inflated to a pressure within the range of about 40 to 60% of the suction pressure of the pump.

3. A combination as defined in claim 1 in which said tank is positioned with its longitudinal axis vertical and in which the means for changing the direction of flow comprises a vertically extending baffle within said tank spaced below said bladder and lying between said inlet and said outlet, whereby gases accumulate in the upper portion of said tank.

4. A combination as defined in claim 1 in which said inlet and said outlet are out of direct alingment for changing the direction of flow.

5. A combination as defined in claim 1 in which said tank is positioned with its longitudinal axis horizontal said stabilizer serving also as a suction manifold for said pump and having a plurality of outlets connected to said pump.

6. A method of stabilizing the inflow of liquid to the suction side of a reciprocating pump which has a given displacement per revolution of its drive, said method comprising passing the liquid through a tank situated between the liquid source and the pump, compressing a gas supply contained within a bladder mounted in said tank as liquid enters the tank between suction strokes, and utilizing pressure of the gas supply to add to the head of liquid entering the pump during suction strokes, the ratio of tank volume to pump displacement per revolution being at least about ten to one, the ratio of tank volme to bladder volume being at least about four to one.

7. A method as defined in claim 6 in which said bladder is inflated to a pressure of about 40 to 60% of the suction pressure of the pump.

8. A method as defined in claim 6, in which the direction of flow of the liquid changes as the liquid passes through said tank to separate gas therefrom, and periodically gas accumulations in the tank are vented.

9. In a suction stabilizer for a reciprocating pump, said stabilizer comprising a tank having an inlet and an outlet for liquids, a flexible resilient bladder within said tank adapted to be inflated with gas, and a cage having perforate walls within said tank adjacent an end wall thereof confining said bladder against wobbling, the ratio of the tank volume to the bladder volume when inflated being at least four to one, the improvement comprising a imperforate baffle within said tank spaced from said bladder and lying between said inlet and said outlet for changing the direction at which liquid flows through said tank.

* * * * *